United States Patent [19]

Koenig

[11] Patent Number: 4,993,649

[45] Date of Patent: Feb. 19, 1991

[54] DUAL AUGER SHREDDER

[76] Inventor: Larry E. Koenig, c/o Komar Industries, Inc., 4425 Marketing Pl., Groveport, Ohio 43125

[21] Appl. No.: 187,229

[22] Filed: Apr. 28, 1988

[51] Int. Cl.[5] ..... B02C 19/22

[52] U.S. Cl. ..... 241/224; 241/235; 241/260.1

[58] Field of Search ..... 241/260.1, 261, 224, 241/229, 235, 242, 248, 251, 252, 236; 366/83, 84, 85, 297, 300, 301

[56] References Cited

U.S. PATENT DOCUMENTS

| | | | |
|---|---|---|---|
| 319,166 | 6/1885 | Anthoine | 241/235 X |
| 768,531 | 8/1904 | Kirby | 241/224 |
| 2,170,303 | 8/1939 | Helstrup | 241/260.1 X |
| 3,698,693 | 10/1972 | Poncet | 366/301 |
| 4,253,615 | 3/1981 | Koenig | 241/260.1 X |
| 4,632,317 | 12/1986 | Wexell et al. | 241/260.1 X |
| 4,655,406 | 4/1987 | Eriksson | 241/261 |
| 4,702,422 | 10/1987 | Chambers, Sr. et al. | 241/236 X |

FOREIGN PATENT DOCUMENTS

| | | | |
|---|---|---|---|
| 218291 | 1/1910 | Fed. Rep. of Germany | 241/235 |
| 471212 | 1/1929 | Fed. Rep. of Germany | 241/236 |

*Primary Examiner*—Joseph M. Gorski

*Attorney, Agent, or Firm*—Thompson, Hine & Flory

[57] ABSTRACT

An energy efficient "large bore" dual auger shredder that is adaptable to waste of different characters and constituents and is capable of conveniently handling large scale bulk is described. Counter-rotating tapered auger screws are mounted on parallel axes in a frame that includes a hopper beneath the axis of the screws that on each side essentially corresponds to the conical taper of the screws. A central exit opening is formed in the hopper bottom beneath the screw axes.

7 Claims, 5 Drawing Sheets

DUAL AUGER SHREDDER

FIELD OF THE INVENTION

This invention relates to waste reduction devices, particularly a dual auger shredder adapted for the processing of large size materials.

BACKGROUND OF THE INVENTION

In the prior art, screw shredders, shear shredders and hammer mills are known as devices by which waste products such as lumber and general industrial and municipal waste are broken into smaller particles and/or homogenized and compacted for further disposal processing. A single auger shredder described in U.S. Pat. No. 4,253,615 is an improvement over such types of shredders and provides a greater degree of efficiency and adaptability to various sized waste materials.

There exists a need, however, to provide a shredder for processing large volumes of waste, for homogenizing bulk volumes and for shredding very large scale waste items. For example, there is a need to provide a means for processing truck load volumes of municipal waste prior to landfill introduction so that air pockets present in conventionally sized "trash bags" that are sealed are removed. There is also a need for a shredder feeder mechanism for mass burn operations at waste disposal sites. Similarly, waste that occurs in the form of bales, such as corrugated cardboard bales or cotton bales, and other large scale waste items such as telephone poles, wire spools, railroad ties, appliances, automobile parts, 55 gallon drums, or other bulky materials are desirably processed by shredding into smaller pieces before incineration, landfill processing or compaction. In like manner, general industrial wastes are desirably shredded and homogenized into a bulk of generally uniform consistency and the invention described herein provides an apparatus for that purpose.

OBJECTS OF THE INVENTION

It is an object of this invention to provide an efficient "large bore" dual auger shredder that is adaptable to waste of different characters and constituents and more particularly to provide a large scale shredder capable of conveniently handling large scale bulk items.

It is a further object to provide a large scale shredder with a large charge opening, which in its operating mechanisms has few close operating tolerances, which is energy efficient and formed from a relatively few separate parts, and which does not depend in its operation on shear points or hammer points as these points are known in prior art shear type and hammer type shredders.

DESCRIPTION OF THE PREFERRED EMBODIMENT

Figure 1:
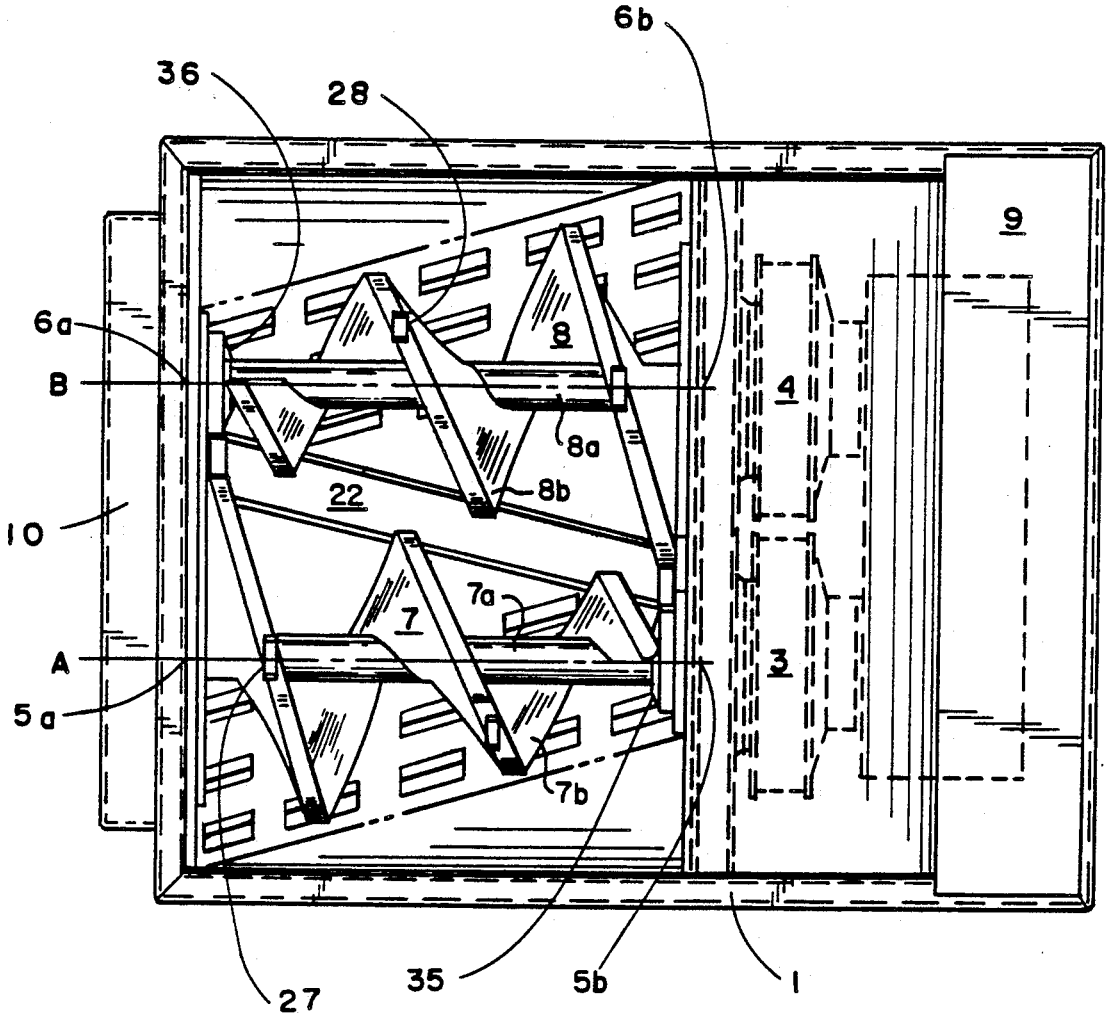
FIG. 1 is a top view of the shredder showing an open hopper and the axial orientation of the counter-rotating screws or augers.

In the preferred embodiment of the dual auger shredder, an auger system provides kinetic energy which is transferred to the material to be shredded. Two counter-rotating screws, which may be individually controlled with respect to speed, as well as direction of movement, concentrate material in a center section between the screws where the material is subjected to the compressive forces of the counter-rotating screws, and the action of "teeth" on the screws co-acting with breaker bars on the hopper floor. Material is thereby shredded. In its operation, control means for the individual screws are comparable to control means described in my prior U.S. Pat. No. 4,253,615 which control means can be adopted to the arrangement herein. For example, the screws may be individually controlled and are preferably reversible in the instance of jams, snags or other discontinuities.

In the invention herein, energy requirements for a shredder are reduced. For example, a hammer mill is a high speed rotating shaft with hammers attached that beat material, usually against some form of anvil or grid, at a rotation speed of about 1200 to 1800 rpm. Hammer mills are typically used for secondary treatment and power requirements are determined by the speed of rotation. A shear shredder works on a shear principle and also has a high energy requirement as well as a maintenance requirement for sharpening the shear point edges, knives or other cutting mechanisms. The present apparatus does not utilize shear points per se and does not depend on close tolerances for its operation. There is no blade-to-blade contact and material introduced in the hopper is broken down and concentrated to a central section. Mechanical force is used to force the material introduced against itself, the screw flites and the teeth and breaker bars, and thereby the material introduced is broken up. The force is not applied against an anvil or sheer point as in such other types of prior art shredders. There is no "preferred" orientation for putting material into the shredder.

The shredder is useful with crates, cable spools up to 8 feet in diameter and larger, general industrial waste such as wood, plastics, parts and aluminum. Bales of cotton and paper, as well as telephone poles, wood dunnage, pallets, railroad ties and tree branches and trunks can likewise be introduced into the shredder. In a particularized application, municipal waste, such as is collected in plastic container trash bags can be homogenized in the shredder. In this manner trash bag air voids can be eliminated in landfill processing.

The absence of specific shear points, close tolerances and small mechanical pieces provides a good maintenance situation. There is no blade to blade contact; and the shredding material is concentrated to a central outlet where homogenized shredded matter can be metered.

A large charge opening is provided which permits the introduction of many different types of materials into the region of operation of the screws. The opening which may be an element of an enclosure for the apparatus is not particularly orientation specific. The counter-rotating auger screws are independently controllable and provide a quiet running machine. While the screws are freely rotating, in operation this movement may be synchronized, depending on the operating environment. When viewed from the small end of a screw, rotation of the screw in a clockwise direction will cause material to be driven from the large diameter end to the end of the screw having the smaller diameter. In the counter-rotating reveresely oriented relationship, material driven by each screw from its larger to its smaller end will be shredded in interaction with material oppositely driven by the other screw. When material is introduced, the combination of the screw forces and the breaker bars in the hopper and the teeth on the screw, pulls in the material and conveys the matter to the center of the hopper by the turning action. The material essentially breaks itself up. The teeth work to pull the material down, in and to the screw. An adjustable bottom opening at the hopper outlet can control the size of the shredded material produced. As the shredded material exits the hopper, it is not compacted, but rather is dispensed as a homogenous mass.

In the top view of the shredder apparatus shown in FIG. 1, a mechanical frame 1 of conventional construction is provided which includes a hopper opening 2 and which supports the screw drive mechanisms 3 and 4 and bearing support systems, 5*a* and 6*a*, and, 5*b* and 6*b*, for the two auger screws 7 and 8 which are reversely tapered with respect to each other. Screws 7, 8 each include substantially cylindrical shafts 7A, 8A and tapered flights 7B, 8B extending radially from them, defining relatively large pumping volumes between the successive turns of the flights. The screws are aligned at parallel axes A and B. Protective coverings 9 and 10 respectively shield the drive means and bearing supports.

Figure 2:
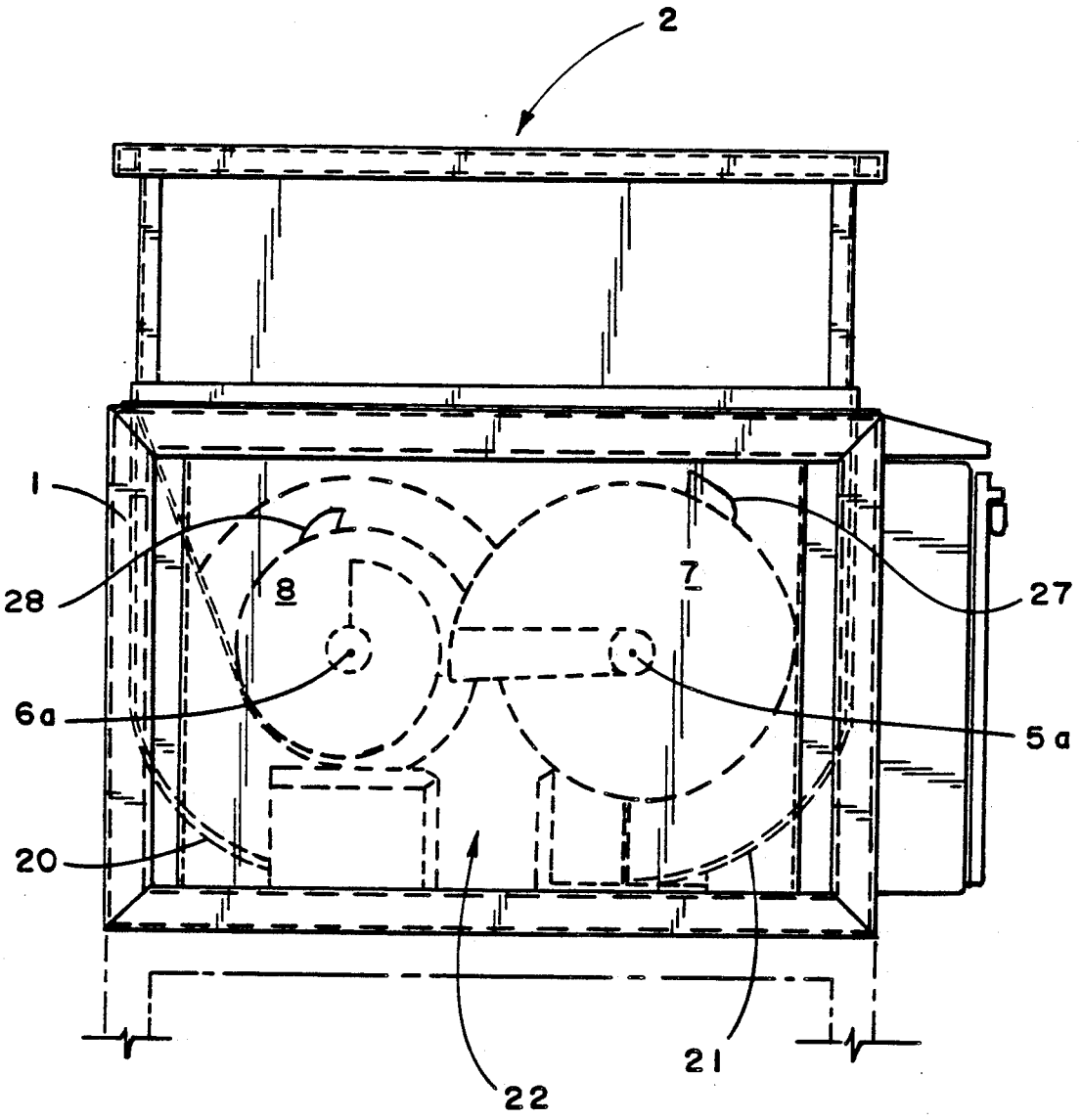
FIG. 2 is a front view of the shredder of FIG. 1.
Figure 3:
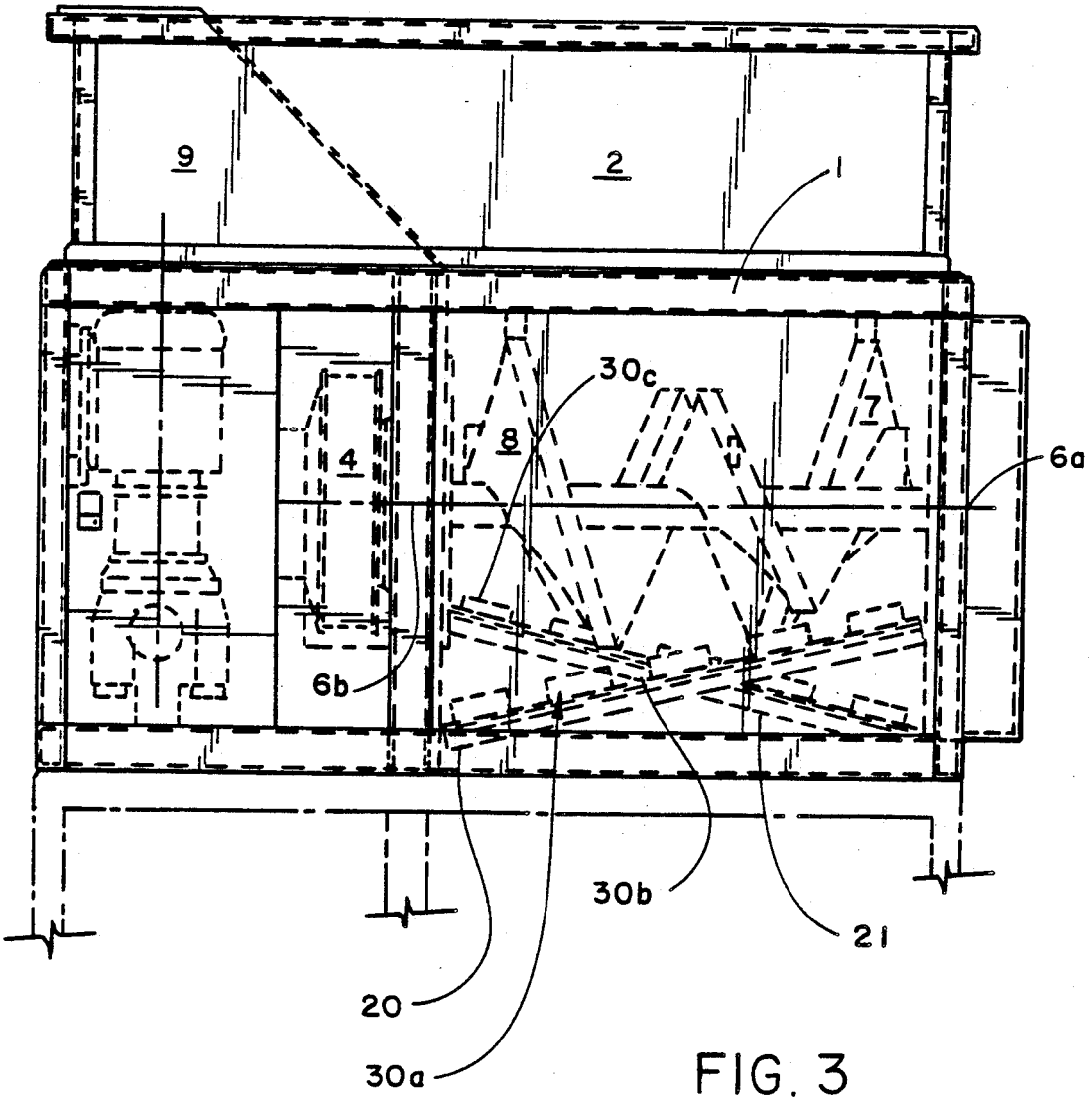
FIG. 3 is a side view of the shredder of FIG. 1.
Figure 4:
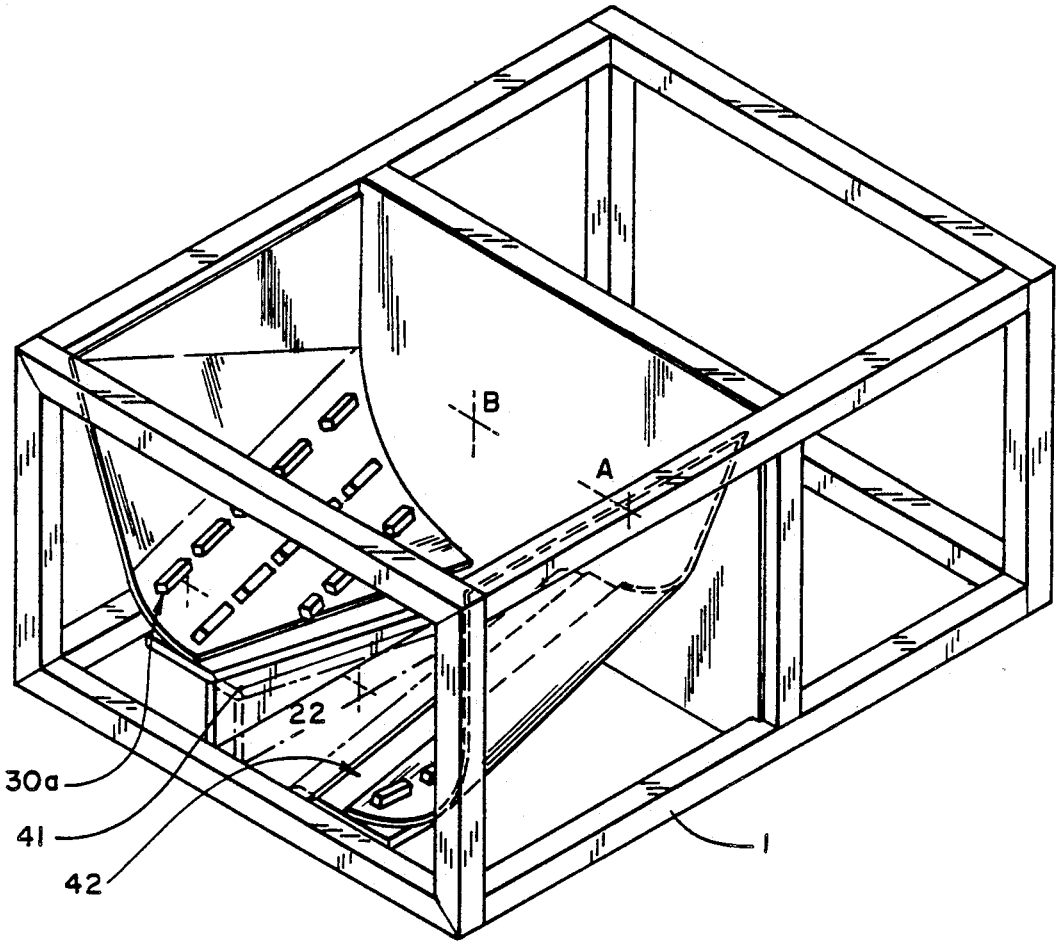
FIG. 4 is a perspective view, showing relative relationships of the hopper floor and the exit opening of the shredder of FIG. 1.
Figure 5:
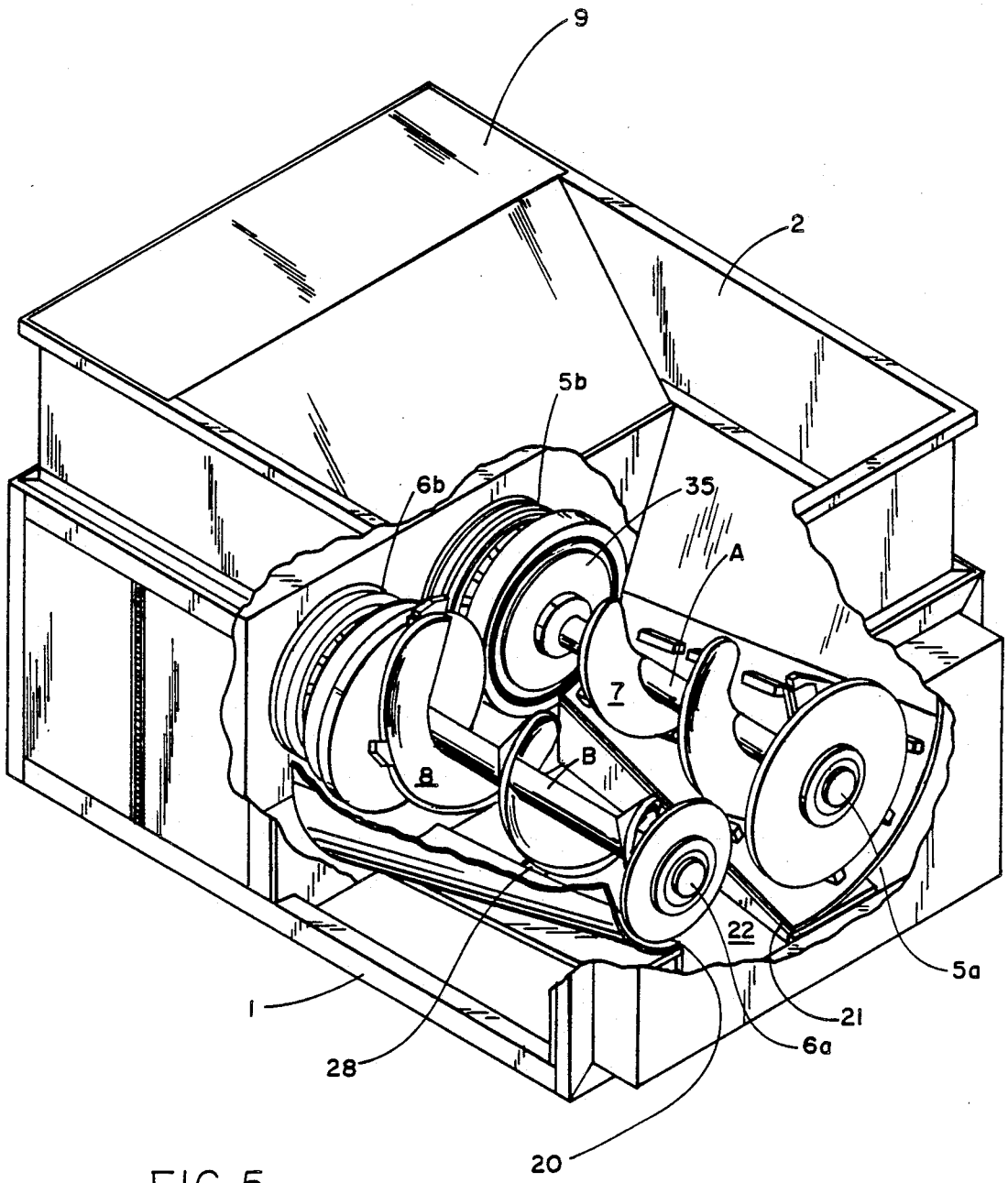
FIG. 5 is an isometric view of the shredder apparatus.

In the front view of FIG. 2, the reversely tapered arrangement of the augers 7 and 8 is shown and the relationship of the hopper bottom segments 20 and 21 to a fixed or adjustable discharge opening 22 is also shown. In the side view of FIG. 3, the angular orientation of the hopper bottom 20 and 21 is shown as the bottom of each side of the hopper is aligned with respect to the corresponding tapers of the auger screws 8 and 7. The form of the hopper bottom section below the axis of a screw is preferably conical, in conformance with the shape of the screw. Breaker bars 30*a*, 30*b*, 30*c*, 30*d*, 30*e*, etc., are shown as mounted on the hopper bottom. FIG. 4 provides a detail view of the breaker bars 30*a*, etc., mounted on the hopper bottom and shows in a phantom depiction a separate means on each side of the hopper bottom 41 and 42 for adjustably defining the size of the exit opening of the shredder. Because the lower sides of the hopper are formed in a shape that follows the taper of the auger screw, the lower sides of the hopper are essentially circumferential in cross-section with respect to the axes of the repective screws. At the exit opening, 22, a compound curvilinear angle results. With respect to each screw, the hopper opening tapers with the screw in one direction from the top to the bottom of the frame. In a second direction following the curvilinear taper of the screw, the opening tapers from one side to the other side of the frame as determined by the screw taper configuration. The position of the sides of the hopper below the screw axes should include sufficient tolerances on the interior thereof for the breaker bars on the hopper interior and the teeth on the screw periphery as the screw rotates.

As noted, the screws are independently controllable and operate normally in a counter-rotating relationship. In the screw flites, the curvature of each flite tapers so that the pitch of the screw increases in proportion with respect to the diameter of the flite section. For example, in a screw tapering from 30 inches to 16 inches, the lesser diameter section of the screw at 16 inches should have a lesser pitch than the pitch of the screw at the greater diameter at 30 inches and the pitch should vary proportionately along the length of the screw. In addition, the screw flite itself is cupped at the edge and the screw is formed from concave castings so that any matter introduced into the apparatus will have a tendency to "roll" as a result of the rotation of the screw in a direction forward from the larger to the smaller end of the screw. Multiple teeth, such as shown at 27 and 28, are provided at the periphery or edges of the screw at spaced locations and traverse through the spaces between the breaker bars at the bottom of the hopper as the screw rotates. A shredding occurs, in part, as a result of the co-action of the teeth, breaker bars and slots. Funnel plates, 35 and 35, are provided at the small end of each screw, which plates rotate with the screws and inhibit material buildup between the screw end and the hopper wall. The plates preferably have a convex or concave curved surface facing towards the hopper interior to induce a "roll off" of material at the screw end, or the plates may be "funnel" (conically) shaped in either direction. A tooth may also be provided at each end of the screw to scrape the hopper wall and prevent a compaction build up between the screw end and the hopper wall or frame of the hopper at the screw end. In this regard, a current detector for an electric drive mechanism and/or pressure detectors located at the walls of the hopper in a control relationship with regard to the drive means may be provided so that the walls of the frame are not pushed out as a result of the intense compaction created as a result of the co-acting screw mechanisms. Likewise, other control means can be provided to detect and cure jams and overloads or otherwise regulate operational performance of the screws in accordance wth predetermined parameters.

Exemplary dimensions of an auger screw suitable for use in the apparatus are: Large diameter 54 inches; length 85 inches tapering to the tip of an end flite of 24 inches in diameter. Screws having other sizes, dimensions and configurations are useful dependent upon design and use parameters. The taper of the screw is essentially conical along the screw length.

The pitch variation of the foregoing screw, beginning at the large diameter end and measured at equidistant points along the screw length ranges from 31 inches to 30 inches to 27 inches to 25 inches to 21 inches at the equidistant points. In such a screw the cupping relationship of the screw flites, again beginning at the large diameter end and measured as continuing through a complete 360° rotation ranges from vertical at the large diameter end, and after a 360° rotation, to 17 inches; and after a second 360° rotation, to 6 inches; and after a third 360° rotation, to 4 inches, measured as the horizontal offset of a line extending perpendicularly from the attachment point of the flite on the axis to the edge of the outer diameter of the screw flite.

The relationship of teeth and breaker bars and spacing of the screws is optionally determined by the type of material with which the shredder is used. A typical tooth, of which 5 or some other suitable number, may be affixed to the screw, ranges in height from about 2 to 4 inches, in length from about 6 to 8 inches and in thickness from about 1 to 2 inches. A tooth having a top curvature in a claw shape such as shown at 27 and 28 is preferable. Matter is readily releaseable from the curved top surface when the screw is reversed; but matter is nevertheless securely gripped in the normal rotating direction. The breaker bars can be from 1 to 3 inches thick, formed from 1 to 2 inch rectangular bar stock.

Typical tolerances include a clearance of 2 inches from the peripheral edge of the screw to the adjacent surface of a breaker bar and 0.5 inch on each side of a tooth as it rotates through the passageway formed by the breaker bars in the hopper interior. It is evident that the screws and teeth must be freely rotating with respect to each other and the breaker bar. As shown in FIG. 1, the teeth are mounted on a longitudinal axis that is perpendicular to the screw axis; the teeth freely traverse through corresponding spaces in the hopper interior formed by the breaker bars.

The foregoing measurements of a suitable screw are representative and overall design of any single apparatus may vary depending on predetermined size and engineering design parameters for a particular application.

The screws typically operate at a low speed range, usually less than 30 rpm, and preferably about 20 rpm. Speed may be varied. The apparatus has an improved tendency not to throw materials, which is a problem encountered with other types of shredders. Power requirements range from 50 to 150 horsepower for each screw depending on application. In contrast, a comparable shear shredder operates at a speed of 40 to 50 rpm and has an energy requirement of about 600 to 800 horsepower.

In the foregoing, an improved and useful shredder is described.

What is claimed is:

1. A shredder for shredding large articles comprising:

a frame defining a shredding chamber having opposing first and second walls;

first and second auger screws mounted substantially parallel to each other within said chamber, each of said screws having a substantially cylindrical shaft and a flight extending radially therefrom tapering in diameter from one end thereof to an opposite end thereof, each of said flights including a plurality of teeth extending radially outwardly from a periphery thereof and being spaced along a length thereof;

said screws being positioned within said chamber such that said screws extend axially from said first wall to said second wall such that a large diameter end of said first auger screw and a small diameter end of said second auger screw are adjacent to said first wall, and a small diameter end of said first auger screw and a large diameter end of said auger screw are adjacent to said second wall, such that said flight of said first auger screw tapers from said first wall towards said second wall, and said flight of said second auger screw tapers from said second wall towards said first wall;

hopper means positioned above said screws for receiving material to be shredded in said chamber;

discharge opening means formed in said frame below said screws for discharging shredded materials from said chamber; and means for counter rotating said screws relative to each other such that material entering said chamber through said hopper is grabbed by said teeth and said flights, pulled downwardly between said screws, and is simultaneously compressed and shredded by interaction of said flights of said screws.

2. The shredder of claim 1 wherein said discharge opening means includes means for adjusting a size of said opening whereby size of material discharged from said shredder may be varied by varying said size of said opening.

3. The shredder of claim 1 wherein said chamber includes a hopper bottom having conical portions shaped to conform to said tapered flights of said screws.

4. The shredder of claim 1 wherein said screws rotate along axes which are substantially parallel to each other.

5. The shredder of claim 1 wherein said chamber includes a hopper bottom having a plurality of breaker bar means positioned thereon and spaced to receive said teeth of said flights therebetween when said screws are rotated.

6. The shredder of claim 1 wherein said screw flights have a concave shape such that material introduced into said chamber and contacted by said rotating screws is forced to roll.

7. The shredder of claim 1 wherein each of said screw flights varies in pitch, decreasing from said large diameter ends to said small diameter ends thereof.

* * * * *